US006615505B2

(12) United States Patent
Pierce

(10) Patent No.: US 6,615,505 B2
(45) Date of Patent: Sep. 9, 2003

(54) ANTI-ENDAZZLEMENT SYSTEM FOR VEHICLE MIRRORS

(76) Inventor: Robert E. Pierce, P.O. Box 1, Wendell Depot, MA (US) 01380

( * ) Notice: Subject to any disclaimer, the term of this patent is extended or adjusted under 35 U.S.C. 154(b) by 0 days.

(21) Appl. No.: 10/056,726

(22) Filed: Jan. 25, 2002

(65) Prior Publication Data

US 2003/0140513 A1 Jul. 31, 2003

(51) Int. Cl.[7] ..... B43L 13/20
(52) U.S. Cl. ..... 33/566; 33/1 B
(58) Field of Search ..... 33/566, 1 B, 1 C, 33/562, 563, 565

(56) References Cited

U.S. PATENT DOCUMENTS

| | | | | | |
|---|---|---|---|---|---|
| 472,266 | A | * | 4/1892 | Kindl et al. | 33/1 B |
| 972,528 | A | * | 10/1910 | Halloran | 33/1 B |
| 1,357,386 | A | * | 11/1920 | Devers | 33/1 B |
| 2,747,795 | A | * | 5/1956 | Kreuttner | 33/1 B |
| 5,511,316 | A | * | 4/1996 | Fischer et al. | 33/562 |
| 6,216,354 | B1 | * | 4/2001 | Carbone | 33/565 |

* cited by examiner

*Primary Examiner*—Christopher W. Fulton
(74) *Attorney, Agent, or Firm*—Joseph E. Funk

(57) ABSTRACT

A template is disclosed for use in measuring and cutting a tinted film for attachment to a mirror to reduce dazzle and glare.

10 Claims, 1 Drawing Sheet

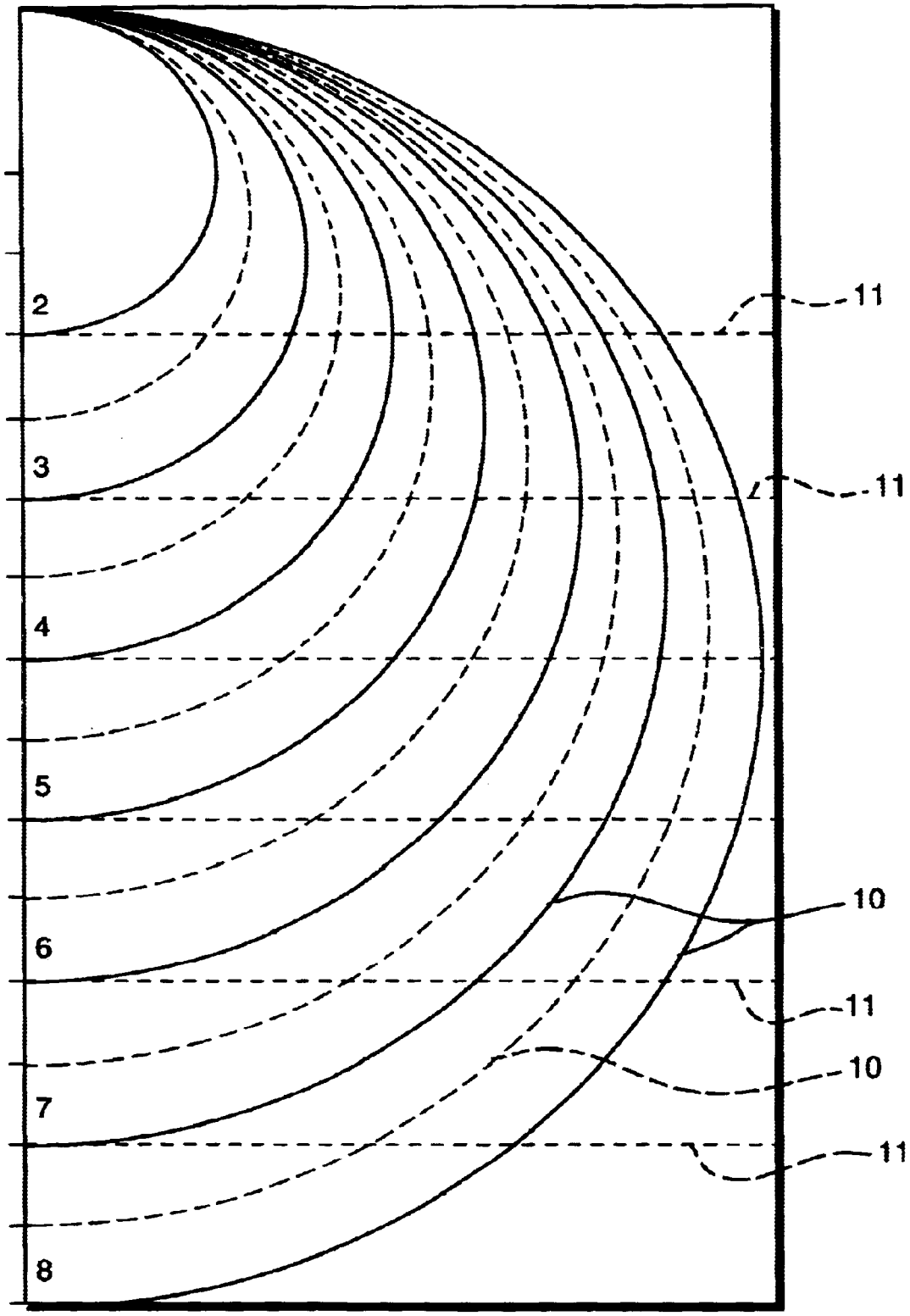
2
3
4
5
6
7
8
11
11
10
11
10
11

ANTI-ENDAZZLEMENT SYSTEM FOR VEHICLE MIRRORS

FIELD OF THE INVENTION

This invention pertains to anti-endazzlement/anti-glare shields that are positioned on vehicle rearview mirrors, and more particularly to templates for making same.

BACKGROUND OF THE INVENTION

The problem of dazzle and glare caused by the reflection of light originating from headlights and the sun from interior and exterior rearview mirrors of a vehicle has long been known and many attempts have been made to alleviate the problem.

A major source of night driving dazzle and glare from both interior and exterior rear view mirrors is from headlights of a trailing vehicle, and particularly if the vehicle has its high beams on. Modern streetlights, such as utilize sodium vapor lamps, are also a source of driving dazzle and glare from rearview mirrors at night. All motor vehicles today have an interior rearview mirror that include a manually operable mechanism for decreasing the reflectance of the mirror to compensate for such dazzle and glare. During earlier and latter daylight hours another major source of driving dazzle and glare from both interior and exterior rearview mirrors is the sun because it is low in the sky and behind the vehicle.

A variety of expensive and inexpensive methods and apparatus have been taught in the prior art to alleviate such reflected dazzle and glare from rearview mirrors. Interior rear view mirrors have a manually operable means to change the reflectance of the mirror as mentioned in the previous paragraph. Exterior rearview mirrors are not provided with such a solution to the dazzle and glare problem. The inexpensive approach to reduce dazzle and glare from an exterior rearview mirror has been to place a piece of tinted film over the mirror, but cutting a piece of such tinted film to fit a mirror is a laborious task. In addition, the tinted film often covers a portion of a mirror that a driver of a vehicle on which the rearview mirror is mounted wishes is not covered.

SUMMARY OF THE INVENTION

To alleviate the problems with prior art tinted films, I provide a tinted film having a release sheet protecting a surface of the tinted film used for self adhering, electrostatically adhering, or adhesively adhering the film to the viewing surface of a mirror, and on the exterior surface of the release sheet is printed a guide for cutting the tinted film that consists of a plurality of straight and curved lines that greatly assist a person in expeditiously cutting the film to the correct size to fit on a rearview mirror. For cuts to be made to the film for which the printed lines are not sufficient, a pin may be used to mark a series of small holes or pinpricks along the edge or near the edge of the mirror, and the film is then cut along the series of holes.

DESCRIPTION OF THE DRAWING

The invention will be better understood upon reading the following Detailed Description in conjunction with the drawing in which:

FIG. 1 shows the cutting guide printed on the exterior surface of the release sheet and that is used to quickly cut the tinted film to the correct size to fit on a rearview mirror.

DETAILED DESCRIPTION OF THE INVENTION

In accordance with the teaching of the present invention a method for quickly cutting a piece of tinted film to the correct size to fit on a rearview mirror is taught and claimed.

There are many sources for tinted and/or polarized film of different types that may be utilized with the present invention.

One such film is taught in U.S. Pat. No. 6,207,236, issued Mar. 27, 2001 to Araki et al. This patent teaches in claims a water-repellent coating film having excellent transparency, abrasion resistance, weather resistance and water repellency, and the method for producing the coating film. The tinted and/or polarized film may be a composite made up of various layers or plies.

Preferably the film is made of a plastic that has a lot of plasticizer added thereto during manufacture to make it very pliable. The resulting film has a very smooth surface that has a micro-suction cup like property that holds the film firmly against the viewing surface of a mirror on which it has been placed.

Alternatively the side of the tinted and/or polarized film that contacts the exterior rearview mirror may have a pressure sensitive adhesive coating for affixing the film to the face of the mirror. The adhesive is compatible with the material of the mirror and the film upon which it is coated to assure positive adherence of the tinted film to a mirror. For example, the adhesive may be an acrylic or urethane pressure sensitive adhesive or a polyester, because the rearview mirror is typically manufactured of glass. The pressure sensitive adhesive is initially covered by a conventional release liner which covers the adhesive until it is removed just prior to attaching the tinted film to a rearview mirror.

The pressure sensitive adhesive is laminated onto one surface of the tinted film which may be made from a polyethylene terephthalate (PET) film, or the film described in the above cited U.S. Pat. No. 6,207,236. While PET is preferred, the film layer could be a polyester or polycarbonate. The film contains a dye to provide the desired degree of tint and color and may also contain a material for absorbing ultraviolet (UV) rays. One UV absorber material for the film is 2,2'-Dihydroxy-4,4- methoxy benzophenone. Alternative compounds include other compatible members of the benzophenone family and compatible members of the benzatriazole family.

To one surface of the tinted film is affixed the layer of laminating adhesive. The laminating adhesive is a polyester resin cross-linked with an isocyanate. Alternative compositions could be acrylic pressure sensitive adhesives or uncrosslinked PET.

Alternatively, a film may be selected that is electrically charged during manufacture, has electrostatic properties, and will adhere electrostatically to the viewing surface of a mirror against which it is placed. The electrostatic cling provides reliable adherence for normal use but is easily broken when desired. A sheet of release type material is attached to the surface of the film that will be used for electrostatically attaching the film to the mirror to protect it from dust and dirt accumulating thereon until the film is ready to be used. Coated onto the surface of the tinted film opposite the layer that contacts a mirror may be a scratch resistant layer that protects the highly plasticized film. This layer serves to protect the film from damage through normal wear and tear. The preferred scratch resistant coating is a hard acrylic polymer. The term, "hard," does not necessarily denote stiffness but refers to a surface that is not easily marred. Other compositions which form protective layers include urethanes and certain inorganic chemical materials.

A conventional release liner covers the surface of the film that will contact a mirror, or will cover the adhesive layer in another embodiment. On the visible side of the release layer is printed a guide or template, shown in FIG. 1, that is extremely useful for expeditiously cutting the tinted film to the correct size to fit on an exterior rearview mirror. The guide consists of a plurality of straight and curved lines that greatly assist a person in determining how to cut the tinted film. Also printed on the visible side of the release layer are directions, not shown in FIG. 1, on how to use the guide/template.

Shown in FIG. 1 are a series of semicircular arcs 10 ranging from two inches to eight inches. There are also a series of spaced parallel lines 11 used to measure rectangular sides of mirrors. A person using the template will use the semicircular arcs to measure the radius of a circular mirror, or the radius of the end of an elongated mirror with semi-circular ends and can cut along the appropriate semicircle. The straight lines are then cut along for straight sides of a mirror. For circular mirrors that are very common on trucks the semicircular lines are used to cut the film into a circle that fits the circular mirror. Large trucks particularly utilize combinations of rectangular mirrors and-round mirrors. Sometimes only a half circle will be cut and affixed to the upper half of a circular mirror to protect from sun dazzle and glare.

The straight and semicircular arc lines may be insufficient in some instances to complete cutting a piece of film to fit a specific mirror. In such instances, after the film has been cut as much as possible using the lines, the film may be placed up against the mirror and a pin used to make a series of pinpricks in the film to mark the edge of the mirror or, preferably, a line near the edge of the mirror. The film is them removed and scissors are used to cut along the pin pricks to complete cutting the film to fit the mirror. The release layer is then removed and the film is attached to the mirror.

When covering, for example, a circular mirror, rather than cutting and mounting a single circular piece of tinted film on the mirror, a user may wish to cut two semi-circular pieces of film and place them side-by-side on the mirror with the straight edges being adjacent to each other and horizontal to the ground. One or the other of the two pieces may be individually removed as desired. In addition, this should be done when placing film on a convex circular mirror to avoid wrinkling of the film.

While what has been the described herein is the preferred embodiment of the invention, it should be understood that one skilled in the art may make numerous changes without departing from the spirit and scope of the invention. For example, the tinted film may also be of a type that blocks ultra-violet rays from passing through the film.

What is claimed is:

1. A template for measuring and cutting a tinted film to be attached to a mirror to reduce dazzle and glare, said template comprising:

A series of arctuate lines, and each arctuate line has a first and a second end, and the first end of each arctuate line lies on the same point; and A series of spaced, straight lines, wherein the straight lines are parallel to each other and are overlaid on the arctuate lines.

2. The template in accordance with claim 1 wherein the tinted film is placed against a mirror and the semi-circular lines are used to determine the radius of a circular mirror or the semi-circular ends of other mirrors, and a cut is made along or parallel to an appropriate semi-circular line to match the curvature of the circular mirror or the semi-circular ends of the other mirrors.

3. The template in accordance with claim 2 wherein while the tinted film is placed against a mirror for determining the circular or semi-circular line cuts, when the mirror has straight edges extending from a semi-circular end the length of the straight edges of the mirror are marked on the straight lines on the template, and cuts are then made along the marked straight lines to match the straight edges of the mirror.

4. The template in accordance with claim 3 wherein the tinted film is placed against a mirror and the lines are used to determine the radius of a mirror or its semi-circular ends, the previously made semi-circular cut is used to mark and make a second semi-circular cut to complete a full circle for a circular mirror, or to cut the semi-circular other end of the mirror.

5. The template in accordance with claim 4 wherein the film is in sheet form and has one surface coated with an adhesive material for affixing the film to the mirror, and further comprising a sheet of release material that is place over the adhesive material, and the template is printed on a surface of the release material that does not contact the adhesive material.

6. The template in accordance with claim 4 wherein the tinted film has electrostatic properties for electrostatically affixing the film to the mirror, and further comprising a sheet of material that is placed on the surface of the film that will be placed against the mirror for affixing the film to the mirror, and the template is printed on a surface of the material that does not contact the film.

7. The template in accordance with claim 4 wherein the tinted film blocks ultraviolet rays from passing through the film.

8. The template in accordance with claim 1 wherein the tinted film is in sheet form and has one surface coated with an adhesive material for affixing the film to the mirror, and further comprising a sheet of release material that is placed over the adhesive material, and the template is printed on a surface of the release material that does not contact the adhesive material.

9. The template in accordance with claim 1 wherein the tinted film is in sheet form and has electrostatic properties for electrostatically affixing the film to the mirror, and further comprising a sheet of material that is placed on the surface of the film that will be placed against the mirror for affixing the film to the mirror, and the template is printed on a surface of the material that does not contact the film.

10. The template in accordance with claim 1 wherein the tinted film blocks ultraviolet rays from passing through the film.

* * * * *